United States Patent [19]

Bailey

[11] Patent Number: 4,549,689

[45] Date of Patent: Oct. 29, 1985

[54] CARTON FOR DISPENSING ROLLED SHEET MATERIAL

[75] Inventor: John G. Bailey, Matteson, Ill.

[73] Assignee: Champion International Corporation, Stamford, Conn.

[21] Appl. No.: 522,744

[22] Filed: Aug. 12, 1983

[51] Int. Cl.[4] ..... B65D 85/67

[52] U.S. Cl. ..... 229/17 S; 206/395; 206/409; 206/626; 225/26; 225/49; 225/50; 225/90; 242/55.53

[58] Field of Search ..... 225/48, 49, 50, 25, 225/26, 90; 229/17 S, 44 R, 45 R, 77, 82, 84, 16 A, 33; 206/395, 396, 409, 621, 628, 626, 631; 220/229, 353; 242/55.53

[56] References Cited

U.S. PATENT DOCUMENTS

| | | | |
|---|---|---|---|
| 1,717,613 | 6/1929 | Meyer | 225/49 X |
| 1,827,029 | 10/1931 | Marcalus | 225/50 X |
| 2,649,239 | 8/1953 | Ellsworth | 229/33 |
| 2,789,746 | 4/1957 | Hovland | 206/621 X |
| 2,793,373 | 5/1957 | Ewing | 220/229 |
| 2,806,591 | 9/1957 | Appleton | 229/17 S |
| 3,182,793 | 5/1965 | Wright | 229/175 X |
| 3,549,066 | 12/1970 | Wankow | 225/48 X |
| 3,720,304 | 3/1973 | Laugherty et al. | 229/84 X |
| 3,974,947 | 8/1976 | Budny | 225/49 X |
| 4,130,228 | 12/1978 | Perrin | 225/49 X |
| 4,284,197 | 8/1981 | Meyers | 229/37 R X |
| 4,417,678 | 11/1983 | Roccaforte | 225/48 X |

FOREIGN PATENT DOCUMENTS

| | | | |
|---|---|---|---|
| 472486 | 3/1951 | Canada | 225/48 |
| 2820566 | 11/1979 | Fed. Rep. of Germany | 220/229 |

*Primary Examiner*—William Price
*Assistant Examiner*—Gary E. Elkins
*Attorney, Agent, or Firm*—Evelyn M. Sommer; William W. Jones

[57] ABSTRACT

A carton is provided for dispensing sheet material from a roll thereof disposed in the carton. The carton has a hood panel and a material tearing member which is preferably mounted on the lower edge of the hood panel. A hood panel engaging portion is provided on the front panel of the carton for releasably holding the hood panel in overlying relationship with the front panel to close the carton. If the carton is used to dispense plastic sheet material, the front panel is provided with one or more openings which allow the end portion of the plastic sheet to be pressed against the roll of plastic sheet through the openings whereby the natural tackiness of the plastic material holds the end portion of the sheet against the outer surface of the front panel of the carton.

15 Claims, 11 Drawing Figures

CARTON FOR DISPENSING ROLLED SHEET MATERIAL

This invention relates to a carton of paperboard material which is used to dispense sheet material from a roll thereof disposed in the carton. More particularly, the carton of this invention includes a material severing edge which is used to sever quantities of the sheet material which are pulled out of the carton and off of the roll.

Cartons which hold a roll of sheet material so that the sheet material can be pulled off of the roll and out of the carton to be severed into usable sheets are known in the prior art. Such cartons include a material severing portion on an edge of the carton and are commonly used to dispense waxed paper, plastic wrapping material, metallic foil wrapping material, and the like. In use, the carton is gripped and the free edge of the material is grasped and pulled so as to unwind however much material is needed from the roll. The unwound sheet material is then drawn across the severing portion of the carton to sever the sheet material from the roll. Between uses, the carton and the contained roll are stored.

When cartons of the character described above are used to dispense plastic wrapping material, one problem which is encountered relates to the free end of the roll of wrapping material being pulled back into the carton after severing, whereupon the free end of the wrapping material readheres itself to the remainder of the roll. When this occurs, the free end of the material is difficult to find due to the transparency of the material and the natural tackiness of the plastic. One aspect of the carton of this invention relates to the provision of a solution for this problem. The carton of this invention includes one or more openings in the front panel thereof across which the plastic material is drawn after it is unwound from the roll and prior to being severed. After severing, the remainder of the plastic material outside of the carton is pressed against the roll of plastic material inside the carton through the openings whereupon the natural tackiness of the plastic causes the material outside the carton to adhere to the roll inside the carton. Thus the free end portion of the plastic material will remain in place against the outer surface of the front panel of the carton. The openings in the front panel of the carton can also be provided with projections at their lower edges, which projections engage the lower edge of the hood panel which overlies the front panel. The hood panel is thus releasably locked against the front panel to hold the carton in a closed condition. By locking the hood panel against the front panel, the free end portions of the sheet material will be caught between the hood and front panels and thus prevented from reentering the carton.

If desired, the locking projections can be formed with one or more serrated tabs cut in the front panel of the carton, which tab or tabs can be deflected back into the carton to expose the locking projections. In this manner, the opening is eliminated and the sandwiching of the sheet material between the front and hood panels is the sole means for preventing the free end of the sheet material from reentering the carton.

Another aspect of this invention which concerns preventing the free end of the sheet material from reentering the carton involves forming the upper end of the front panel of the carton with lateral guide tabs. When the sheet material is pulled out of the carton over the top edge of the front panel, the lateral edges of the sheet material pass beneath the guide tabs so that when the sheet is severed, the guide tabs prevent the newly formed free end of the sheet material from reentering the carton.

Another aspect of the invention relates to means for controlling the unwinding rolling of the roll of material in the carton as it is pulled out of the carton and severed. When the severing of the material is performed, it is desirable that the roll be held firmly, but the fact that it is inside of the carton renders this immobilization difficult without crushing the carton, especially as the roll becomes smaller through depletion. The carton of this invention can include finger openings in the back or other panel whereby one's fingers may enter the carton to grasp the roll directly. Alternately, a portion of the carton wall may be made deflectable against the roll to hold the latter firmly against rotation.

It is, therefore, an object of this invention to provide a carton adapted to dispense severed sheets of material from a roll thereof contained in the carton.

It is a further object of this invention to provide a carton of the character described which includes provisions for preventing the free end of the sheet material from reentering the carton after a severed sheet is dispensed therefrom.

It is an additional object of this invention to provide a carton of the character described wherefrom plastic sheet material is dispensed and which carton has one or more openings in its front wall panel to allow the free end portion of the sheet material outside the carton to be pressed against the roll of sheet material inside the carton via the openings whereby the tackiness of the plastic sheet material will cause the free end portion thereof to be held against the outside of the carton front wall panel.

It is another object of this invention to provide a carton of the character described which includes one or more projections formed on the front wall panel of the carton to engage and releasably hold the hood panel of the carton against the outer surface of the front wall panel.

It is yet another object of this invention to provide a carton of the character described which is provided with openings or a deflectable portion which may be used to enable better gripping of the roll of sheet material during dispensing thereof.

These and other objects and advantages of the carton of this invention will become more readily apparent from the following detailed description of several preferred embodiments thereof taken in conjunction with the accompanying drawings, in which.

Figure 3:
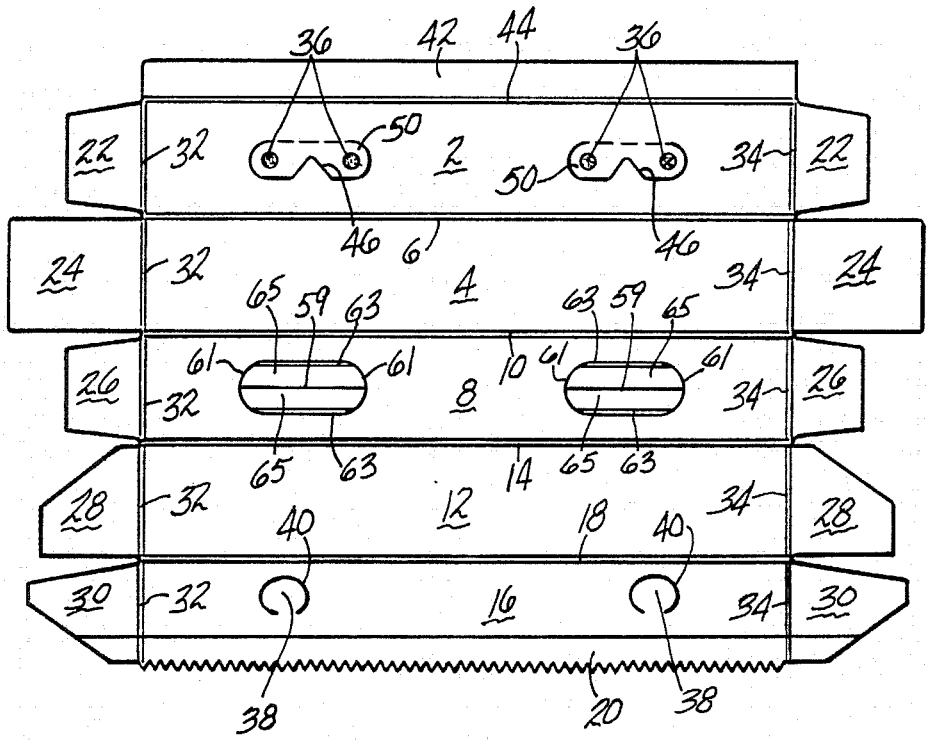
FIG. 3 is a plan view of a cut and scored blank from which a third embodiment of a carton formed in accordance with this invention is erected.
Figure 6:
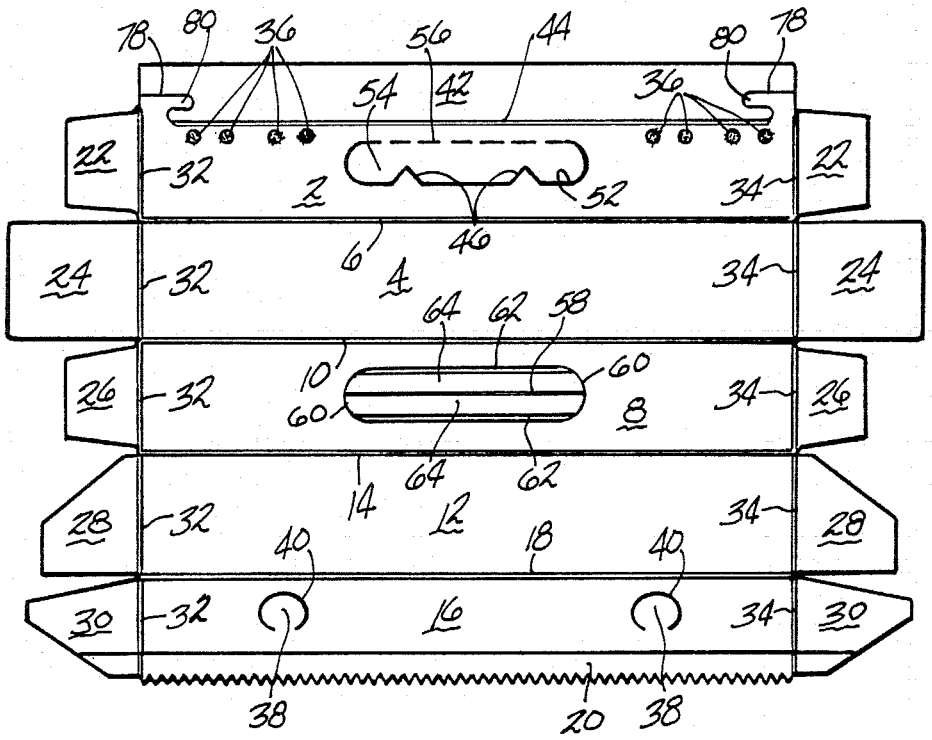
FIG. 6 is a plan view of a cut and scored blank from which a sixth embodiment of a carton formed in accordance with this invention is erected.
Figure 10:
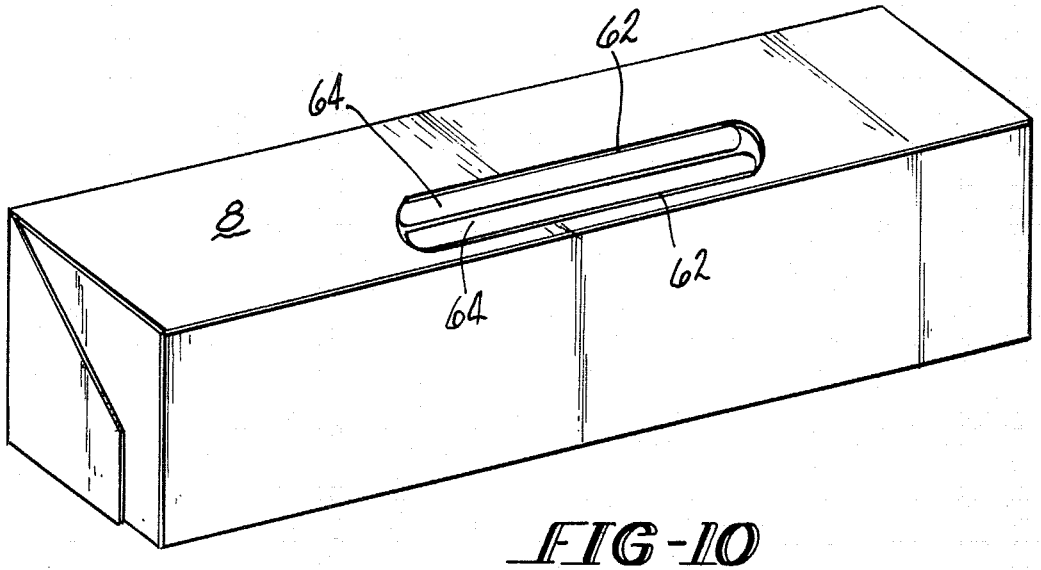
Figure 11:
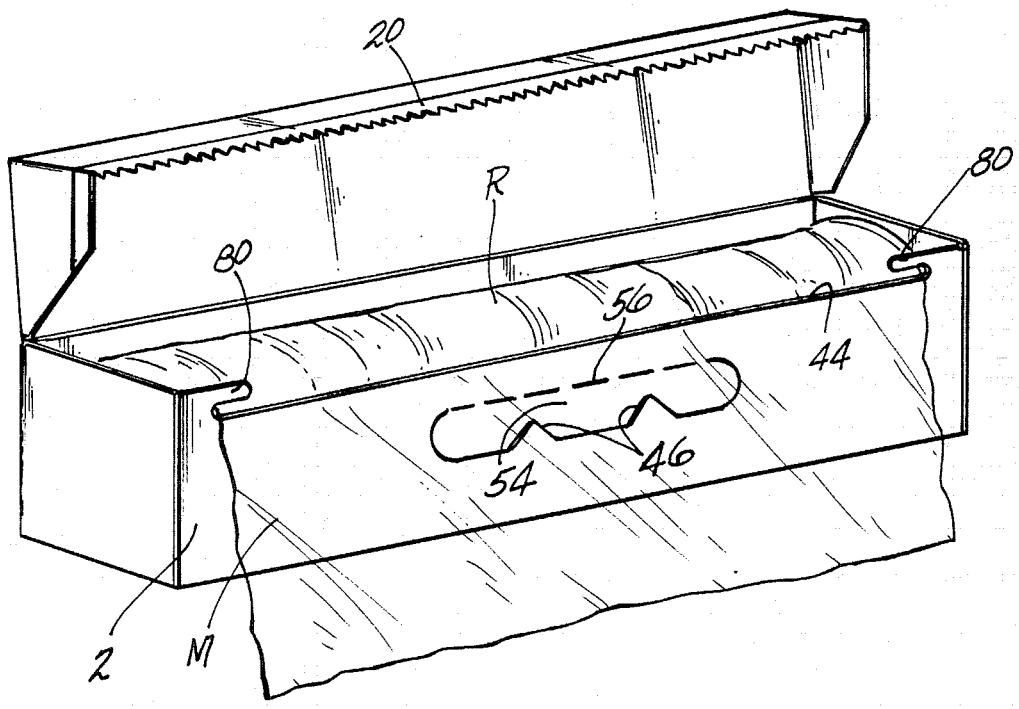

FIG. 10 is a perspective view of the carton erected from the blank of FIG. 3 showing the manner in which the cut and scored portion of the carton wall panel can be utilized to facilitate manual control of the roll of material as the latter is unwound in the carton; and FIG. 11 is a perspective view of the carton erected from the blank of FIG. 6 showing the manner in which withdrawn sheet material is restrained from reentering the carton.

Referring now to the drawings, FIGS. 1–6 disclose various embodiments of cut and scored paperboard blanks formed in accordance with this invention. In connection with the following description of the contents of FIGS. 1–6, like reference numerals will be used to denote like components of the several blanks shown. The various blanks all include a front wall panel 2 having a bottom wall panel 4 foldably connected thereto along a score line 6. A back wall panel 8 is foldably connected to the bottom wall panel 4 along a fold line 10, and a top wall panel 12 is foldably connected to the back wall panel 8 along a fold line 14. A hood panel 16 is foldably connected to the top wall panel 12 along a fold line 18, and a serrated material severing member 20 is mounted on the free edge of the hood panel 16. End closure flaps 22, 24, 26, 28 and 30 are foldably connected to carton panels 2,4,8, 12 and 16 respectively along fold lines 32 and 34. A plurality of adhesive spots 36 are provided on the front wall panel 2 for securing the hood panel 16 in overlying relationship to the front wall panel 2 to close the carton. A pair of push tabs 38 are formed by arcuate cuts 40 in the hood panel 16, the tabs 38 being operable to be pushed manually against the underlying front wall panel 2 of the closed carton to break the adhesive bond between the panels 2 and 16 thereby allowing the carton to be opened. A reinforcing panel 42 is foldably connected to the front wall panel 2 by a fold line 44, the panel 42 being foldable against the inside surface of the front wall panel 2 to reinforce and strengthen the upper edge of the front wall panel 2.

Figure 2:
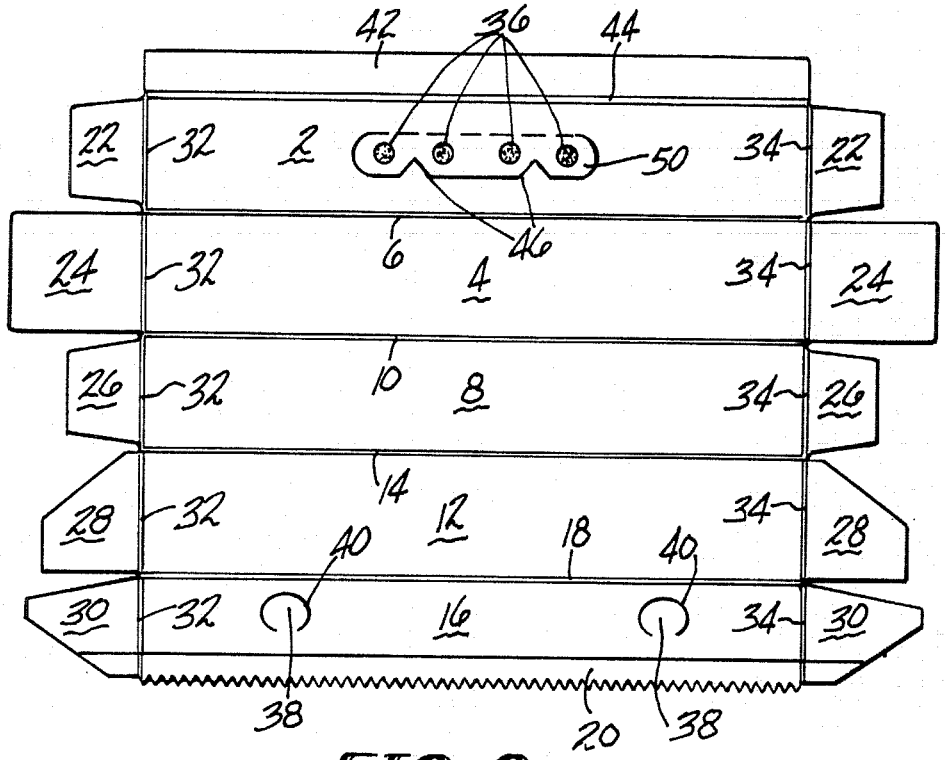
FIG. 2 is a plan view of a cut and scored blank from which a second embodiment of a carton formed in accordance with this invention is erected.
Figure 1:
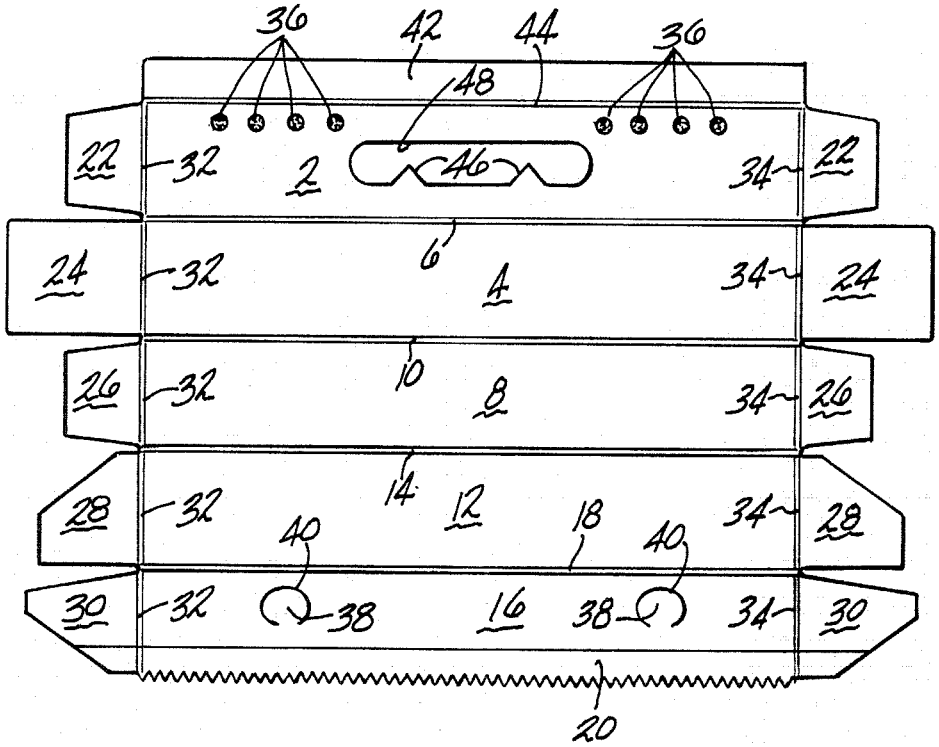
FIG. 1 is a plan view of a cut and scored blank from which a first embodiment of a carton formed in accordance with this invention is erected.
Figure 4:
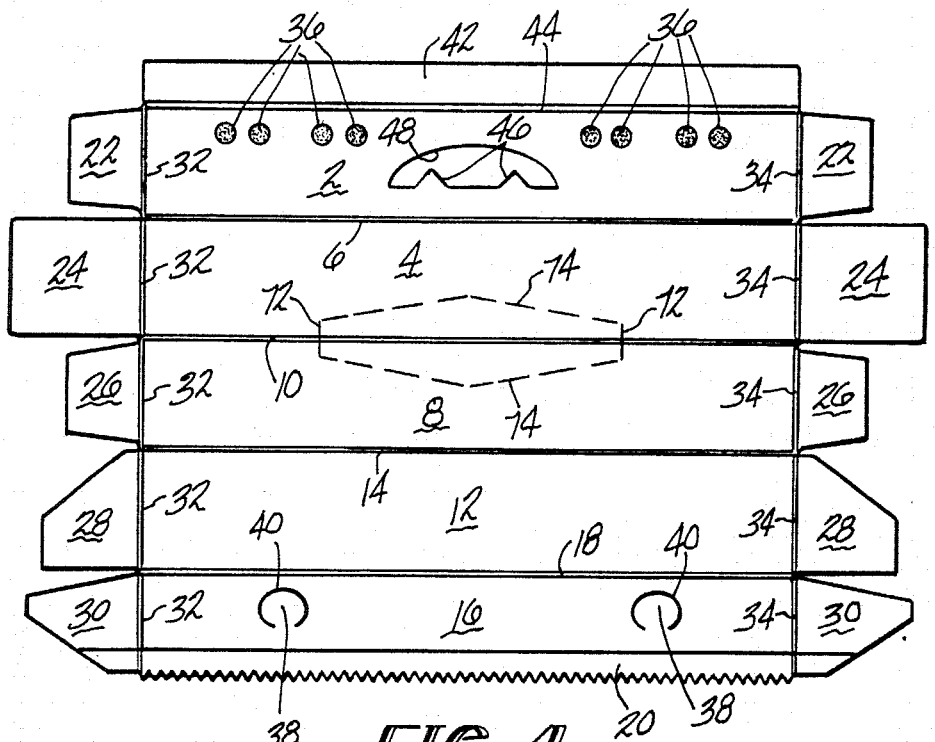
FIG. 4 is a plan view of a cut and scored blank from which a fourth embodiment of a carton formed in accordance with this invention is erected.
Figure 5:
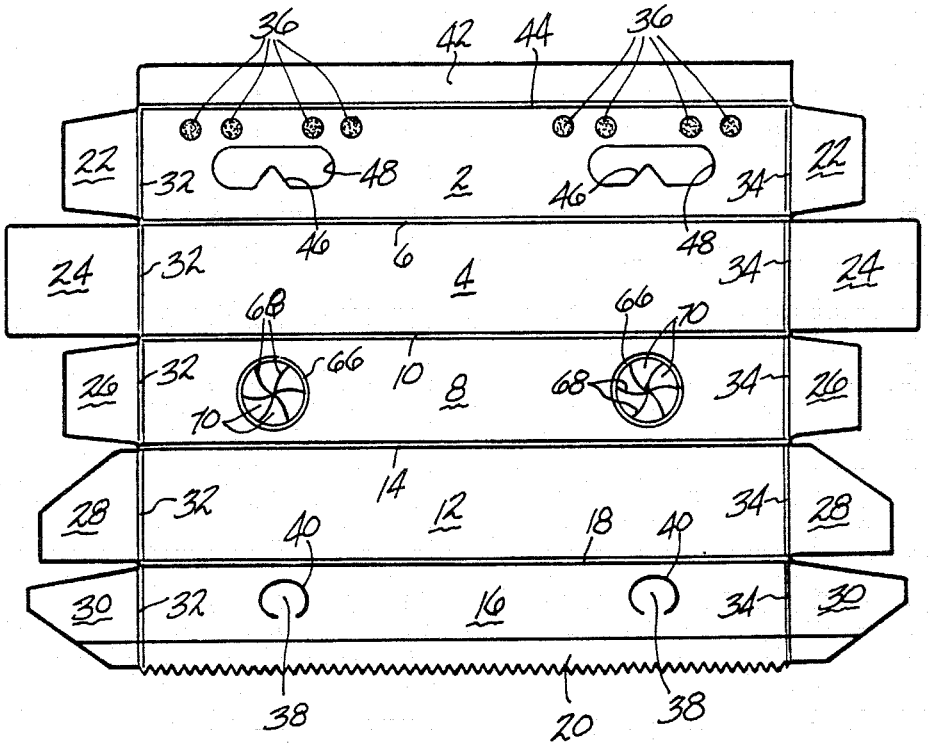
FIG. 5 is a plan view of a cut and scored blank from which a fifth embodiment of a carton formed in accordance with this invention is erected.

The front wall panel 2 is provided with one or more locking projections 46 which are operable to interlock with the free edge of the hood panel 16 to reclose the carton, as will be set forth in greater detail hereinafter. The projections 46 may be formed along the edge of one or more cut out openings 48 formed in the front wall panel 2, as shown in FIGS. 1, 4 and 5. Alternatively, the projections 46 may be formed along edges of one or more tear out tabs 50 formed in the front wall panel 2, as shown in FIGS. 2 and 3. In the latter case, the adhesive spots 36 are deposited on the tear out tabs 50 so that when the carton is initially opened, the tabs 50 will be torn out of the plane of the front wall panel 2 to leave behind one or more openings in the front wall panel 2 similar to the openings 48. Another way to form the locking projections 46 on the front wall panel 2 is to form them along a cut line 52 defining a free edge of a deflectable tab 54 which has another edge thereof connected to the front wall panel 2 along a bendable fold line 56. After the carton is opened, the tab 54 is deflected manually back into the carton to expose the locking projections 46. The latter embodiment is shown in FIG. 6.

When the sheet material is being unwound from the roll thereof, which is disposed in the carton, to be severed by the material cutting member 20, it is desirable to be able to manually control the rotation of the roll within the carton so that material will not be wasted. To this end, the carton may be formed with finger openings which are normally closed but which can be opened manually to allow one or more fingers to enter the carton and engage the roll to throttle rotation of the latter. Such finger openings can be formed in a number of different ways. For example, the back wall panel 8 of the carton can include a medial cut line 58 bounded at its ends by a pair of arcuate cut lines 60, as shown in FIG. 6. A pair of parallel fold lines 62 extend between respective ends of the arcuate cut lines 60. In this manner, a pair of opposed deflectable flaps 64 are formed in the back wall panel 8. As shown in FIG. 10, these deflectable flaps 64 can be manually pivoted about the fold lines 62 and pushed into the carton to allow entry of one's fingers into the carton to engage the material roll disposed in the carton. The central positioning of the flaps 64 on the panel 8 allows the fingers of either hand to be thus used when the carton is gripped during material dispensing. An alternative arrangement for enabling finger grasping of the sheet material roll is shown in FIG. 3. The alternative arrangement involves the use of a pair of medial cut lines 59 disposed at opposite ends of the back wall panel 8 and bounded at their ends by curved cut lines 61. The respective ends of the curved cut lines 61 are connected by parallel bendable fold lines 63 to form respective pairs of deflectable flaps 65. The flaps 65 operate in the same way as the embodiment shown in FIG. 10. The placement of the flaps 65 at both ends of the carton allows the use of either hand to grip the carton and contact the material roll. Yet another embodiment for enabling finger engagement of the material roll to throttle rotation of the latter is shown in FIG. 5. The third embodiment involves the use of a pair of circular bendable fold lines 66 disposed in opposite end portions of the back wall panel 8. A plurality of radial cuts 68 of bipartite curvilinear configuration extend across the circle formed by the fold line 66, the cuts 68 all intersecting at the center of the circular fold line 66. In this manner, a plurality of generally triangular inwardly deflectable flaps 70 are formed at each end of the back wall panel 8. The flaps 70 can be deflected inwardly to allow entry of a finger into the carton to contact the material roll. This material roll throttling access can be used with either hand gripping the carton since the arrays of deflectable flaps are disposed at either end of the panel 8.

Figure 9:
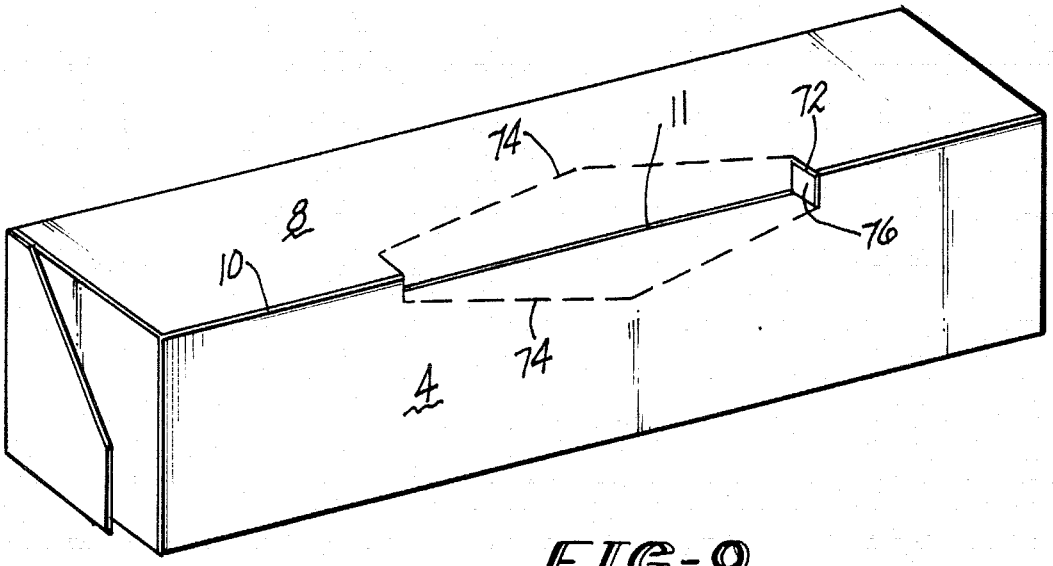
FIG. 9 is a perspective view of the carton erected from the blank of FIG. 4 showing the manner in which a part of the carton panels can be depressed inwardly to facilitate manual control of the roll of material as the latter is unwound in the carton.

Still another embodiment of a structure for allowing manual throttling of the material roll when the latter is unwound is shown in FIGS. 4 and 9. In the latter embodiment, a pair of parallel cut lines 72 extend across and perpendicular to fold line 10 whereby opposite ends of the cut lines 72 are disposed in the bottom wall panel 4 and the back wall panel 8. Extending between respective ends of the cut lines 72 are a pair of V-shaped cut score bend lines 74. Referring to FIG. 9, it will be noted that when pressure is applied to the medial portion 11 of the fold line 10, the medial portion 11 will deflect into the interior of the carton and the cut lines 72 will open to form respective diamond-shaped openings 76 in the carton. The medial portion 11 of the fold line 10 will thus be pressed against the material roll in the carton to allow throttling of the roll as material is unwound off of the roll. Finger pressure will be used to cause the inward deflection of the fold line portion 11.

Figure 7:
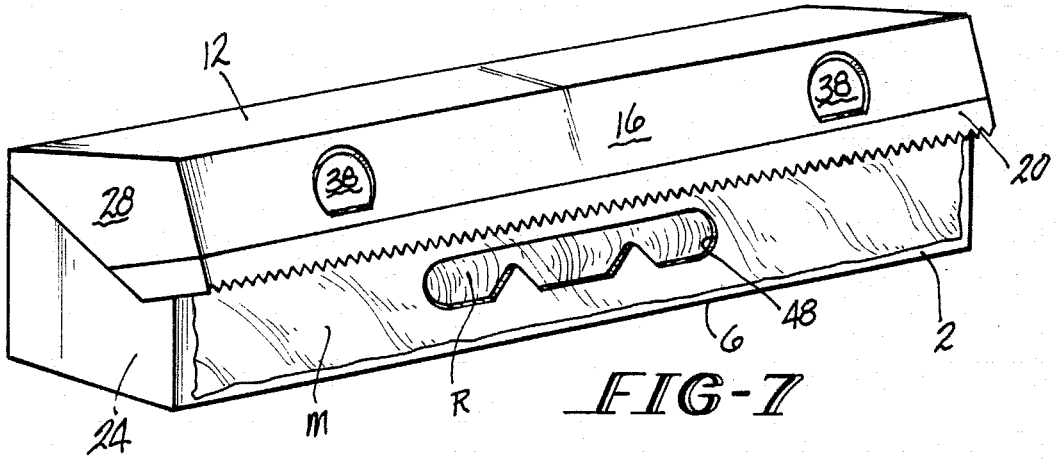
FIG. 7 is a perspective view of the carton erected from the blank of FIGS. 1 or 2 showing the sheet material being withdrawn from the roll thereof in the carton.

Referring now to FIG. 7, the erected carton is shown after the push tabs 38 have been pressed inwardly to break the adhesive bond between the front wall panel 2 and the hood panel 16 and to release the hood panel 16 to allow withdrawal of material M from a roll R thereof contained in the carton. The material M is withdrawn from the carton and roll R in the conventional manner and drawn across the cutting member 20 to sever a usable sheet from the remainder of the material. As seen from FIG. 7, after the sheet of material is cut off of the remainder, there will be a portion of the material M which will extend from the carton and overlie the outer surface of the front wall panel 2. The opening 48 in the front wall panel 2 is upwardly offset from the fold line 6 sufficiently that it will lie beneath the hood panel 16 when the latter is moved back down into overlying relationship with the front wall panel 2. Thus the extended portion of the material M will overlie the opening 48 in the front wall panel 2. To help prevent the extending portion of the material M from reentering the carton and readhering to the roll R inside the carton, the extending portion is manually pressed against the roll R through the opening 48. The natural tackiness of the plastic material being dispensed causes the extending terminal portion of the material M to adhere to the roll of material R in the carton through the opening 48. The extended material M is thus held in place against the outer surface of the front wall panel 2 and prevented from reentering the carton. This mode of retaining the extended material outside of the carton may be utilized with any sheet material which possesses inherent tackiness, such as plastic wrapping material like polyvinylidene chloride film.

Figure 8:
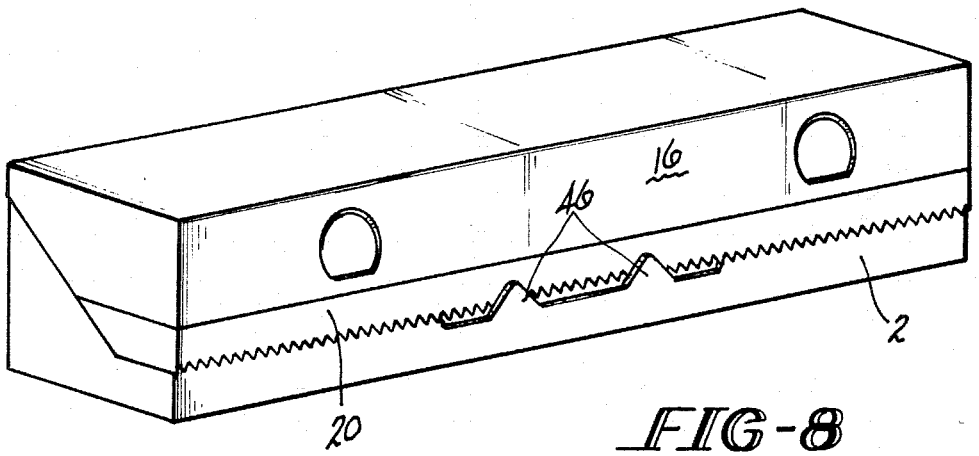
FIG. 8 is a perspective view of the carton of FIG. 7 but showing the carton in a reclosed condition after dispensing sheet material therefrom.

Referring now to FIG. 8, the manner in which the carton is reclosed when not in use is shown. After the material has been severed, the hood panel 16 is moved into overlying relationship with the front wall panel 2 and the cutting member 20 is tucked underneath the locking projections 46. Thus, the locking projections serve to releasably hold the hood panel 16 against the outer surface of the front wall panel 2. It will be appreciated that the retention of the hood panel 16 against the front wall panel 2 traps the extended portion of the sheet material M between these two panels 16 and 2 and further acts to prevent the sheet material M from reentering the carton. Thus, in the case where a tacky sheet or film is being dispensed, there is a dual mechanism for preventing the extended material M from reentering the carton. When a non-tacky material, such as waxed paper, metallic foil, or the like is being dispensed, the trapping of the extended portion of the sheet will be sufficient to prevent reentry into the carton.

It will be appreciated further that when a non-tacky material is being dispensed, the carton embodiment of FIG. 6 can be used and the flap 54 will be pivoted back into the carton about the fold line 56 to expose the locking projections 46.

When the embodiments of FIGS. 2 and 3 are used, the opening or openings in the front wall panel 2 will be created by the tearing out of the flaps 50 when the carton is opened, since the flaps 50 will adhere to the inner surface of the hood panel 16 due to the adhesive spots 36. This tearing out of the flaps 50 also creates the locking projections 46.

Referring now to FIGS. 6 and 11, there is shown an alternative embodiment of a dispensing carton which includes a mechanism for preventing the extended portion of the sheet material from reentering the carton. This embodiment of the carton can be used for dispensing tacky or non-tacky materials. As shown in FIG. 6, a pair of generally S-shaped cuts 78 extend from opposite ends of the fold line 44 to the free side edges of the reinforcing panel 42. These cuts 78 define a pair of lateral guide tabs 80 which flank the fold line 44 and which face each other. As seen from FIG. 11, when the reinforcing panel is folded against the inside surface of the front wall panel 2 about the fold line 44, the guide tabs 80 will remain erect in the plane of the front wall panel 2. When the material M is drawn off of the roll R, the lateral edges of the material M will slip beneath the guide tabs 80, which project toward each other and will move across the fold line 44. When the material M is severed by the cutting member 20, the material left behind extending from the carton will have its lateral edges remain beneath the guide tabs 80 so that the guide tabs 80 will tend to prevent the extending material M from returning to the interior of the carton. A secondary retention of the extending material M will be provided, as previously explained, when the flap 54 is pushed back into the carton to expose the locking projections 46 and the cutting member 20 is locked in place beneath the locking projections 46 to reclose the carton.

It will be readily appreciated that the carton of this invention is adapted to prevent the extended portion of sheet material being dispensed from reentering the carton so that a readily available portion of the sheet is always presented for easy gripping for further dispensing. This feature is particularly desirable when a relatively tacky plastic wrapping film is being dispensed from the carton. Furthermore, the carton also features provisions for manually controlling the rate at which the roll of material rotates within the carton as the material is being withdrawn from the roll.

Since many changes and variations of the disclosed embodiments of the invention may be made without departing from the inventive concept, it is not intended to limit the invention otherwise than as required by the appended claims.

What is claimed is:

1. A carton for dispensing sheet material from a roll thereof disposed in said carton, said carton comprising:

(a) a front wall panel, a bottom wall panel, a back wall panel, and a top wall panel foldably connected together in series;

(b) a plurality of end closure flaps foldably connected to respective ones of said panels to form end closures for said carton;

(c) a hood panel foldably connected to said top wall panel to overlie an outer surface of said front wall panel;

(d) material cutting means disposed at an edge of one of said panels for severing material dispensed from said roll of material; and (e) means forming an opening in said front wall panel, said opening having an upper edge and a lower edge spaced downwardly from said upper edge and means forming at least one locking projection in said front wall panel at the lower edge of said opening in said front wall panel, said locking projection extending upwardly toward but terminating short of said upper edge of said opening in said front wall panel and being positioned to overlap an outer surface of a lower edge of said hood panel when the latter is juxtaposed to said front wall panel whereby said hood panel can be releasably locked into overlying relationship with said front wall panel to close the carton, said opening being formed by boundaries of at least one flap cut in said front wall panel which flap is pivotable into said carton about a fold line defining said upper edge of said opening and said flap having a lower edge contoured to form said locking projection in the portion of said front wall panel adjacent said flap lower edge.

2. The carton of claim 1, wherein said flap is connected to said front wall panel by rupturable score lines and said flap carries adhesive means for securing said hood panel to said front wall panel, said flap being tearable away from said front wall panel when said hood panel is moved away from said front wall panel to open the carton.

3. The carton of claim 1 wherein said material is a naturally tacky plastic film wrap, and said opening is interposed between said upper edge of said front wall panel and said material cutting means whereby a portion of said material connected to said roll overlies an outer surface of said front wall panel and extends across said opening to provide means for adhering said portion of said material to said roll through said opening to retain said portion of said material outside of said carton.

4. The carton of claim 1 further comprising means forming a second opening in one of said top, back and bottom wall panels to provide a finger entry into said carton to allow finger contact with said roll in said carton to throttle rotation of said roll during dispensing of said material.

5. A carton for dispensing a naturally tacky plastic wrap sheet material from a roll thereof disposed in said carton, said carton comprising:

(a) a front wall panel, a bottom wall panel, a back wall panel, and a top wall panel foldably connected together in series;

(b) a plurality of end closure flaps foldably connected to respective ones of said panels to form end closures for said carton;

(c) a hood panel foldably connected to said top wall panel to overlie an outer surface of said front wall panel;

(d) material cutting means disposed at an edge of one of said panels for severing material dispensed from said roll of material;

(e) means forming at least one opening in said front wall panel, said opening being disposed between an upper edge of said front wall panel and said material cutting means; and (f) said material cutting means being disposed on said carton so that a portion of said material connected to said roll will overlie said outer surface of said front wall panel and will also overlie said opening in said front wall panel after severing of material by said material cutting means, said opening providing an access whereby said portion of said material can be pressed through said opening to adhere to said roll of material in said carton due to the natural tackiness of said material so that said portion of said material will remain in overlying relationship to said outer surface of said front wall panel.

6. The carton of claim 5, wherein said opening is formed by a flap which is cut from said front wall panel and is removable therefrom after said carton is opened.

7. The carton of claim 6, wherein said flap is provided with adhesive means for securing said hood panel to said front wall panel.

8. The carton of claim 5, wherein said opening has a profiled lower edge forming at least one locking projection positioned with respect to a lower edge of said hood panel so as to overlap an outer surface of said hood panel to releasably lock said hood panel in overlying relationship to said front wall panel to close said carton.

9. The carton of claim 5, further comprising means forming at least one additional opening in one of said top, back and bottom wall panels to provide a finger entry into said carton to allow finger contact with said roll in said carton to throttle rotation of said roll during dispensing of said material.

10. A carton for dispensing sheet material from a roll thereof disposed in said carton, said carton comprising:

(a) a front wall panel, a bottom wall panel, a back wall panel, and a top wall panel foldably connected together in series;

(b) a plurality of end closure flaps foldably connected to respective ones of said panels to form end closures for said carton;

(c) a hood panel foldably connected to said top wall panel to overlie an outer surface of said front wall panel;

(d) material cutting means disposed at an edge of one of said panels for severing material dispensed from said roll of material; and (e) a pair of opposed material guide tabs disposed at each upper corner of said front wall panel, said guide tabs being integral with said front wall panel and having elongated portions disposed above an upper edge of said front wall panel and spaced apart therefrom, said elongated portions extending toward each other to overlie lateral edges of sheet material drawn from said roll and pulled over said upper edge of said front wall panel to form means for preventing portions of said material attached to said roll and extending beyond said upper edge of said front wall panel from reentering said carton after severing of a usable quantity of said material by said material cutting means.

11. The carton of claim 10, further comprising a reinforcing panel connected to said upper edge of said front wall panel along a fold line, said reinforcing panel being folded into face-to-face contact with an inner surface of said front wall panel and adhesively secured thereto, and said guide tabs being delineated by a pair of generally S-shaped cuts disposed at each end of said fold line, said S-shaped cuts extending to opposite free side edges of said reinforcing panel.

12. A carton for dispensing sheet material from a roll thereof disposed in said carton, said carton comprising:

(a) a front wall panel, a bottom wall panel, a back wall panel, and a top wall panel foldably connected together in series;

(b) a plurality of end closure flaps foldably connected to respective ones of said panels to form end closures for said carton;

(c) a hood panel foldably connected to said top wall panel to overlie an outer surface of said front wall panel;

(d) material cutting means disposed at an edge of one of said panels for severing material dispensed from said roll of material; and (e) at least one generally circular bendable score line disposed in at least one of said top, back and bottom wall panels, and a plurality of radial cut lines extending between opposite sides of said score line, said radial cut lines intersecting at the center of the area contained within said score line thereby forming a finger entry into said carton to allow finger contact with said roll in said carton to throttle rotation of said roll during dispensing of said material.

13. The carton of claim 12 wherein said radial cut lines are curvilinear.

14. A carton for dispensing sheet material from a roll thereof disposed in said carton, said carton comprising:

(a) a front wall panel, a bottom wall panel, a back wall panel, and a top wall panel foldably connected together along corner fold lines;

(b) a plurality of end closure flaps foldably connected to respective ones of said panels to form end closures for said carton;

(c) a hood panel foldably connected to said top wall panel to overlie an outer surface of said front wall panel;

(d) material cutting means disposed at an edge of one of said panels for severing material dispensed from said roll of material;

(e) a first cut line formed in said back wall panel and extending across one back corner fold line into one of said top and bottom wall panels;

(f) a second cut line formed in said back wall panel and spaced apart from said first cut line, said second cut line extending across said one back corner fold line into said one of said top and bottom wall panels, said first and second cut lines flanking a medial portion of said one back corner fold line; and (g) score lines extending between corresponding ends of said first and second cut lines, said score lines and said cut lines defining a throttling panel which is articulated by said medial portion of said one back corner fold line, said throttling panel being deflectable into said carton to engage said material roll to throttle rotation of said roll during dispensing of said material.

15. A method for dispensing sheet material from a roll of sheet material disposed in a carton having a plurality of wall panels, said sheet material being naturally tacky, said method comprising the steps of:

(a) grasping a free end of said material on said roll and unwinding said material from said roll to withdraw a portion of said material from said carton and over a free edge of said carton;

(b) severing a terminal portion of said withdrawn material at a location remote from said free edge of said carton so as to leave a remaining portion of said material attached to said roll and exteriorly of said carton; and (c) pressing a part of said remaining portion of said material through an opening in one of said wall panels in said carton and offset from said free edge of said carton to cause said part of said material to adhere to said roll of said material within said carton by reason of the natural tackiness of said material.

* * * * *